United States Patent [19]

Funger

[11] Patent Number: 4,813,141

[45] Date of Patent: Mar. 21, 1989

[54] CARPET SEAM CUTTER

[75] Inventor: Edward A. Funger, Stoney Creek, Canada

[73] Assignee: The PerfecTrim Limited Partnership, Hamilton, Canada

[21] Appl. No.: 63,352

[22] Filed: Jun. 18, 1987

[30] Foreign Application Priority Data

May 20, 1987 [CA] Canada ..... 537507

[51] Int. Cl.[4] ..... B26B 29/04

[52] U.S. Cl. ..... 30/290; 30/293

[58] Field of Search ..... 30/290, 280, 278, 286, 30/293; 7/103

[56] References Cited

U.S. PATENT DOCUMENTS

| | | | |
|---|---|---|---|
| 1,077,880 | 3/1926 | Stuart . | |
| 1,177,024 | 3/1916 | Dragos . | |
| 1,808,239 | 6/1931 | Logan . | |
| 1,940,855 | 12/1933 | Friedman . | |
| 2,679,100 | 5/1954 | Ehler . | |
| 2,729,889 | 1/1956 | Trinski . | |
| 3,596,356 | 8/1971 | O'Neal | 30/280 |
| 3,726,010 | 4/1973 | Yokoyama . | |
| 3,737,932 | 6/1973 | Armijo | 7/103 |
| 3,965,575 | 6/1976 | Stunger . | |
| 4,137,631 | 2/1979 | Pickett et al. . | |
| 4,393,587 | 7/1985 | Kloosterman . | |
| 4,620,368 | 11/1986 | Bowman . | |

*Primary Examiner*—Frank T. Yost
*Assistant Examiner*—Willmon Fridie, Jr.
*Attorney, Agent, or Firm*—Patrick J. Hofbauer

[57] ABSTRACT

A device for cutting overlapped carpet sections so as to produce matched seams is disclosed. The device comprises a generally planar base plate having an upper and a lower surface. Two generally planar side plates are provided on the base plate adjacent the respective opposed side edges of the base plate so as to protrude downwardly below the lower surface. A handle having a longitudinal axis is affixed to the upper surface of the base plate between the two side plates with the longitudinal axis in angled relation to the upper surface and in generally parallel relation to the side plates. A cutting blade is rigidly and adjustably affixed to the device between the side plates with its cutting edge in generally parallel relation to the longitudinal axis, the cutting blade protruding sufficiently below the lower surface so as to be positionable in operative cutting relation to the overlapped carpet sections.

11 Claims, 2 Drawing Sheets

CARPET SEAM CUTTER

Figure 1:
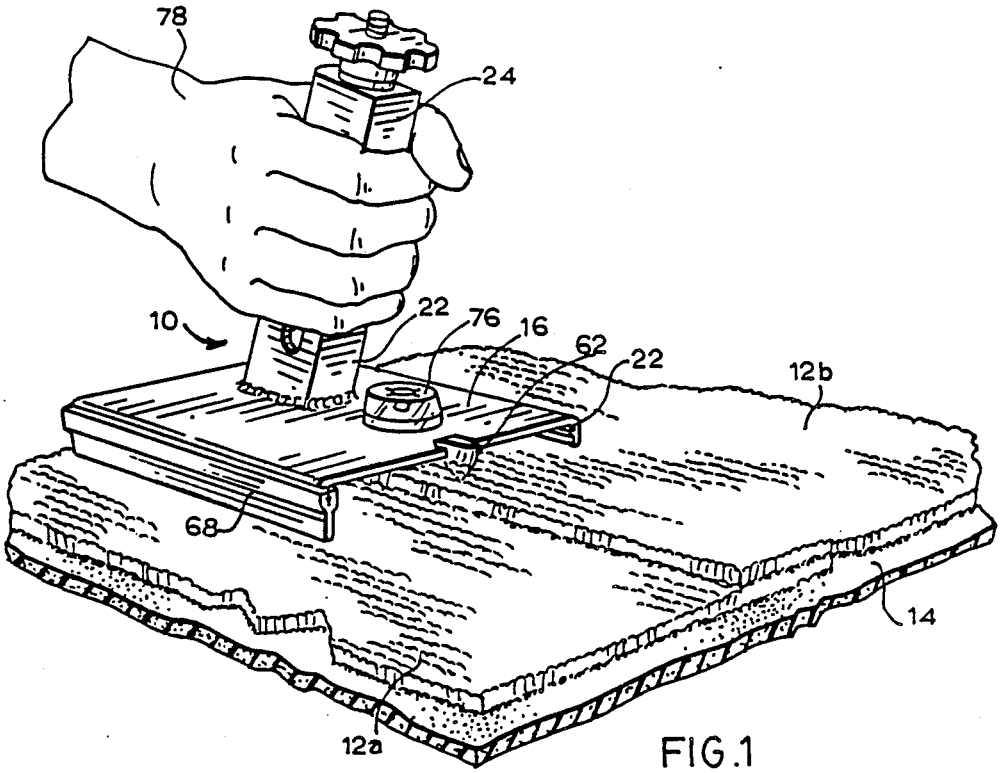

This invention relates generally to the field of hand-held cutting devices, and is particularly concerned with the provision of a hand-held device for cutting carpet sections. Use of a cutting device according to the invention is particularly advantageous where the respective cut edges of adjoining pieces of carpet are to be matched and the matched seam created thereby is to be hidden, so far as possible, from view.

In installing so-called "wall-to-wall" carpeting, it is frequently necessary to match cut sections of carpet to one another in order to completely cover the floor area of a particular room. Additionally, it may be desirable to add sections of a contrasting coloured carpet, either as a perimeter border to a room, or otherwise. In any of these instances, the matched seams may be either straight or curved. When matching of carpet sections in this manner is required, it is desirable for carpet installers to overlap the carpet sections to be matched and to thereafter simultaneously cut through both overlapped sections so that the cut in both sections will be similarly profiled.

In an "exactly even" match, the fibre backing of the carpet sections will abut one another substantially along the entire length of the matched seam. It is, however, desirable in particular circumstances to cut the carpet sections to be matched to achieve what is known in the art as a "thick" or a "thin" match. In a "thick" match, the fibre backing of the matched sections of carpet are cut so as to overlap one-another a pre-determined amount uniformly along substantially the entire length of the matched seam. In a "thin" match, the fibre backing of the carpet sections so do not actually touch, but are separated by a uniform space along substantially the length of the matched seam.

Presently known cutting devices suitable for this activity are unsatisfactory. The carpet cutting device of the present invention is primarily designed to be utilized in such overlapped cutting of carpet sections, although it can also be used in cutting through single sections of carpet. Moreover, prior art cutting devices are not adopted to make "thick", "thin" and "exactly even" matches as described above. The tool of the present invention is designed to selectively produce all three types of matched seams by reason of the adjustability of its side plates working in combination with a levelling device affixed to the base plate of the device. That is to say, the device of the present invention will cut an "exactly even" match when the base plate is held level relative to the overlapped carpet sections, and will cut "thick" or "thin" matches when one or other side of the base plate is positioned lower than the other side, so as to angle the cutting blade.

Although carpet cutting devices for use in overlapped cutting operations as just described have been previously proposed, they have not found wide acceptance in the carpet installation industry because of their inability to cut "thick", "thin" and "exactly even" matched seams, and because of their complexity and awkwardness in use. All of these contribute to the poor results obtained therewith. In fact, the inadequacy of prior art carpet cutting devices for this application is so prevalent that no known device has obtained any degree of acceptance in the carpet installation industry. As a result, cutting matched seams in carpet today is almost exclusively carried out by installers in singular fashion (as opposed to an overlapped fashion) with simple razor knives or so called "utility knives". This process is not only extremely slow and tedious, but requires considerable effort, and eye to hand co-ordination skill on the part of the installer. Most importantly, the matched seams created thereby are often quite visible and, therefore, unsatisfactory. Even where the matched seam cuts so carried out are relatively straight, they are in most cases visible to the eye which may result in customer complaints. The visibility problem is largely due to what will be hereafter referred to as "carpet shaving". That is, because of lateral movement of the blade (i.e. to either side of the line of cutting) of the utility knife or other conventional hand-held cutting device during the cutting operation, the carpet pile immediately adjacent to the cut is often cut shorter than its original length, thus accentuating visibility of the matched seam. Where the carpet is matched with an adjoining seam which is similarly cut, the problem is compounded. These shortcomings (i.e. carpet shaving and crooked cuts) occur primarily because of lack of stability of the blade in the holder of the utility knife, or other prior art cutting device.

Installer hand fatigue is generated in two ways. The strength and concentration required by the installer to maintain lateral stability of the cutting blade is considerable, even where the blade holder of the cutting device used is relatively stable. Moreover, strength and concentration by the installer is necessary to maintain an efficient cutting attitude (i.e. angle of cutting edge to plane of carpet section). Therefore, conventional hand-held carpet cutting devices result when used in overlapped carpet section cutting, in rapid installer hand fatigue, which in turn causes the aforementioned poor results and possible work slowdown or stoppage.

It is, therefore, an object of the present invention to provide a device for cutting carpet which device is simple and relatively inexpensive to manufacture. Such device is particularly suited for making matched seam cuts in overlapped carpet sections, which matched seam cuts may be "thick", "thin" or "exactly even", as previously defined.

It is a further object of this invention to provide a device for cutting carpet sections suitable for use by carpet installers which device minimizes "carpet shaving" typically associated with matched seam cutting of overlapped carpet sections, and which makes it easier to cut straight seams in carpet sections.

It is a further object of the present invention to provide a device for cutting carpet which device significantly, reduces the hand fatigue experienced by users of the device and which device requires little skill on the part of the user for its successful utilization.

It is yet a further object of this invention to provide a carpet cutting device which is adapted for use as aforesaid in relation to carpets of various thicknesses.

A device for cutting carpet in accordance with the invention comprises a generally planar base plate having an upper and a lower surface and two generally planar side plates mounted on the base plate adjacent respective opposed side edges of the base plate so as to protrude downwardly below said lower surface. A handle means having a longitudinal axis is, in use, rigidly affixed to the upper surface of the base plate between the two side plates with the longitudinal axis in angled relation to the upper surface, and in generally parallel relation to the opposed side edges. A blade means, having a cutting edge, is rigidly affixed to the device between the side plates, with the cutting edge in generally parallel relation to the aforesaid longitudinal axis. The blade means protrudes sufficiently below the lower surface so as to be positionable in operative cutting relation to the carpet.

In a preferred embodiment of the invention, the handle means is substantially hollow so as to form a housing and the blade holder is adapted for adjustable mounting within the housing so as to allow for variable positioning of the cutting edge below the lower surface of the base plate. Moreover, in use, one or more adjustment sleeves are slidably engageable with the side plates so as to provide for level operative positioning of the base plate over two overlapped sections of carpet positioned for cutting therebeneath. In this manner, the cutting device is allowed to cut the two edges of the fibre backing to be relatively flush to one another ("exactly even" match) or slightly "thick" or slightly "thin" to one another, as desired by the installer. Moreover, the device is in this manner adapted to accommodate different thicknesses of carpet with generally equal facility. It is desirable to integrate a position indication scale with the handle means to indicate the operative vertical position of the blade holding means. It is also preferable to include a cutting indicator means on the upper surface of the base plate so as to indicate the operative plane of the cutting edge. A level indicator means is also advantageously positioned on the upper surface of the base plate.

Figure 1A:
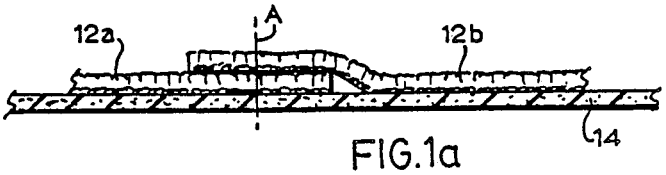
Figure 1B:
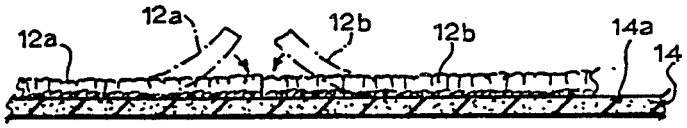
Figure 2:
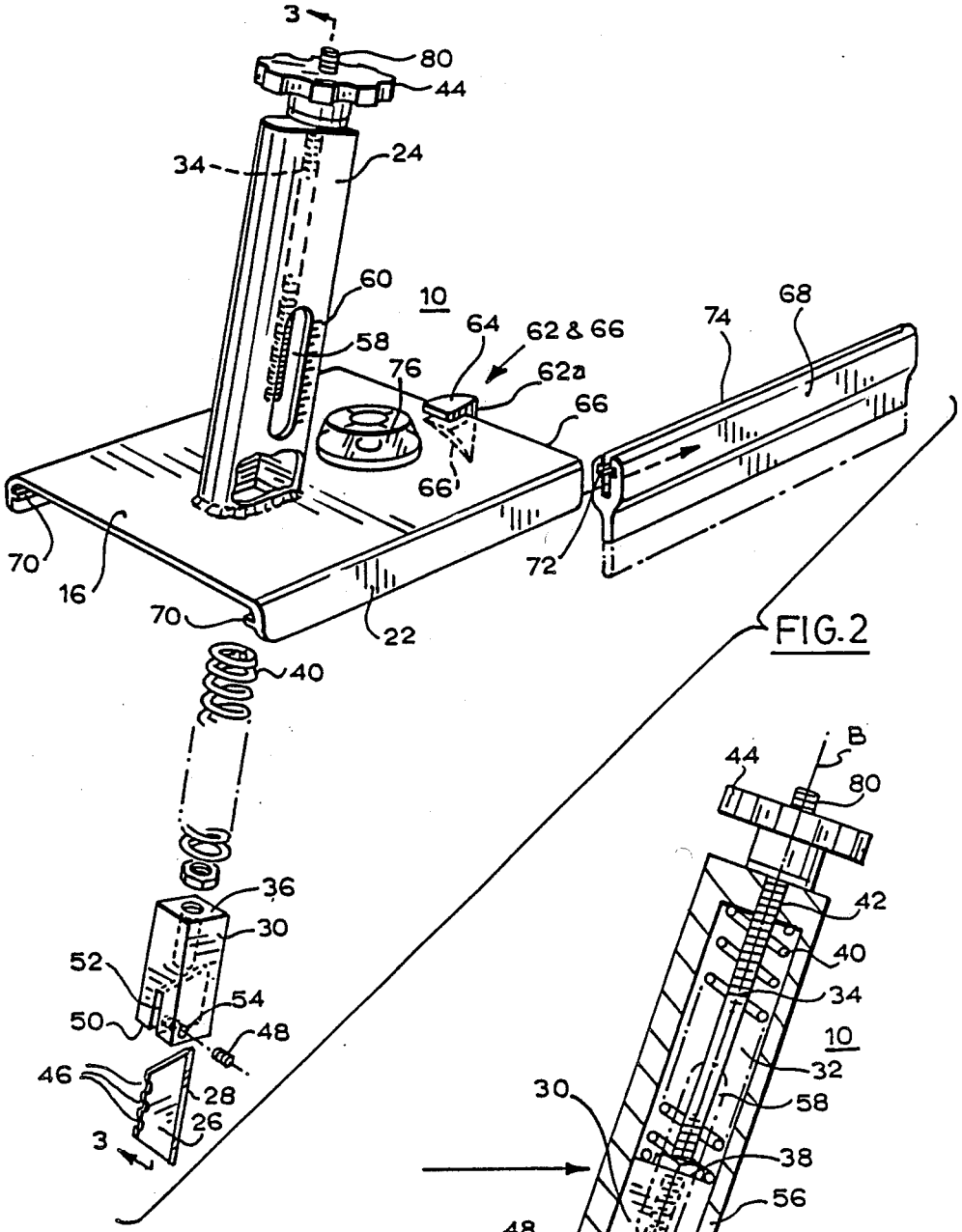
Figure 3:
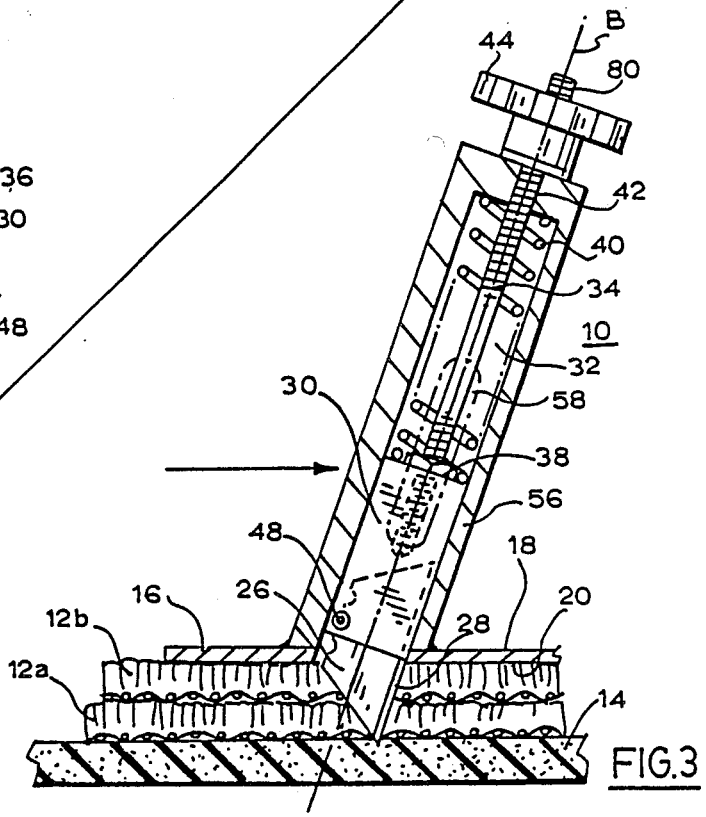

A device for cutting carpet according to the invention will now be described in detail by way of example only, with reference to the drawings in which:

FIG. 1 is a perspective view of a preferred embodiment of carpet cutting device according to the invention, in use on two overlapped sections of carpet;

FIG. 1*a* is a cross-section of the overlapped sections of carpet shown in FIG. 1, prior to cutting;

FIG. 1*b* is a cross-section similar to FIG. 1*a*, showing the two carpet sections of FIG. 1 in aligned matched relation after cutting;

FIG. 2 is a partially exploded view of the carpet cutting device of FIG. 1; and, FIG. 3 is sectional view of the carpet cutting device of FIG. 2 along line 3—3 of FIG. 2.

Referring to the Figures, wherein like numerals are used to designate similar parts throughout the various views, there is shown a device (generally designated by the reference numeral 10) for cutting carpet sections 12*a* and 12*b* which carpet sections 12*a*, 12*b* are shown overlying an underpad 14 constructed of rubber or similar cushioning material. FIG. 1 shows the device 10 in use in a typical application, wherein the carpet sections 12*a* and 12*b* are overlapped for matched seam cutting. FIG. 1*a* shows the carpet sections 12*a* and 12*b*, with the line along which the carpets are to be cut labelled "A". In matched seam cutting, after the carpet sections 12*a* and 12*b* are cut along line "A", they may be matched as shown in diagrammatic fashion in FIG. 1*b*. The phantom outline of carpet sections 12*a* and 12*b* indicate an unmatched position in which the sections may be postioned subsequent to cutting, but prior to matching, with the curved arrows indicating their movement into matching relationship, at which relationship the sections 12*a* and 12*b* lie substantially flush on the top surface 14*a* of the underpad.

FIG. 1 shows a carpet cutting device 10 according to the invention in use atop the overlapped carpet sections 12*a* and 12*b* of FIG. 1*a*. The device comprises a generally planar base plate 16 having an upper 18 and a lower 20 surface, each of which are substantially planar.

Two generally planar side plates 22 are laterally positioned on the base plate adjacent to the opposed side edges of the base plate, so as to protrude downwardly below the lower surface 20. As shown, these side plates are integrally formed in with the base plate 16, but it should be expressly understood that they may be separate members, either rigidly or adjustably affixed to the base plate 16.

A substantially hollow handle means 24 is rigidly affixed to the upper surface 18 of the base plate 16 in a central location between the side plates 22. The handle means 24 is preferably rigidly and permanently affixed to the base plate 16, but could, for example, in a more compact version of the device, be detachable from the base plate, it merely being essential that the handle be rigidly affixed, in use, to the base plate 16. Moreover, the handle means 22 has a longitudinal axis (shown as broken line B in FIG. 3) which axis lies in angled relation to the upper surface 18 and is in generally parallel relation to the planes defined by the two side plates 22. It will be appreciated that the side plates 20 need not be perfectly planar in order to be operative; however, such planar profile is preferred. In the case of non-planar side plates, the aforementioned longitudinal axis would be parallel to a plane perpendicular to the upper planar surface 18 of the base plate 16.

It has been found by routine experiment that the preferred angle of the longitudinal axis of the handle member 24 to the upper surface 18 of the base plate 16 is approximately 15°, although other angles are also operative. A 19° angle is preferable with a blade means 26 of the general type shown, which blade means 26 has a straight cutting edge 28. The cutting edge 28 is, in operation, in generally parallel relation to the longitudinal axis, as this angle appears to promote maximum cutting efficiency, with minimum installer fatigue.

The blade means 26 is rigidly affixed to the device 10 in a central position between the side plates 22 with the cutting edge 28 in substantially parallel relation to the longitudinal axis. Moreover, the blade means 26 protrudes sufficiently below the lower surface 20 so as to be positionable in operative cutting relation to the carpet sections 12*a* and 12*b* as best seen in FIG. 3. Such operative position is any position wherein the cutting edge 28 is able to penetrate completely through the uppermost carpet section 12*b* and substantially through the lowermost section 12*a* and may, at least partially, cut through the upper surface 14*a* of the underpad 14. As described in more detail below, the positioning of the blade means 26 of the present invention is adjustable, and the positioning shown in FIG. 3 is the preferable operative adjustment position.

The handle means 24 is preferably, as shown, substantially hollow so as to form a longitudinal housing 32 and a blade holding means 30 is adapted for adjustable sliding mounting within the housing 32 so as to allow for variable positioning of the cutting edge 28 below the lower surface 20 of the base plate 16. The blade holding means 30 is so adapted by means of a threaded rod 34 which is screw-threaded into the upper end 36 of the blade holding means 30 and is locked in such screw-threaded engagement by means of a lock nut 38. A coil spring 40 is surroundingly mounted around the threaded rod 34 and the entire assembly is slid into the housing 32, with the free end 80 of the threaded rod 34 protruding through an aperture 42 in the upper end of the housing 32. A threaded handle 44 screw-threadingly engages the threaded rod 34 on the outside of the housing 32 so as to, upon tightening, raise the blade holding means 30. The blade means 26 is a standard "utility knife" blade having three locating knotches 46 positioned along a lateral edge opposite to the cutting edge 28. The blade holding means 30 is bifurcated at its lower end 50 by means of a transverse slot 52. A threaded bore 54 transversely intersects the slot 52 so as to accept an Alan (trade mark screw 48 in received relation.

To fit the blade means 26 into the blade holding means 30, a selected one of the locating notches 46 is engaged by the Alan screw 48 and the entire assembly, including the threaded rod 34 and the coil spring 40 is slid into the housing 32, whereupon the uppermost portions of the cutting edge 28 engage a side wall 56 of the housing 32, so that the blade means 26 is held rigidly between said side wall 56 and the Alan screw 48, when the device 10 is moved in the direction of the arrow of FIG. 3.

Where carpet sections having relatively thicker piles are to be matchingly cut, the threaded handle 44 is slackened, so that the spring biasing of the coil spring 40 pushes the blade holding means 30 downwardly as seen in FIG. 3. When the threaded handle means is tightened, it draws the blade holding means 30 upwardly into the housing 32, so as to variably position the blade means 26 below the lower surface 20 of the base plate 16. In this manner, the cutting device 10 is able to accommodate carpet sections of varying thickness, and, regardless of such thickness, obtain the preferred operative cutting relation with said sections 12*a*, 12*b* and underpad 14, as shown in FIG. 3. While it is desirable for maximum stability of the blade means 26 to insert the blade into the blade holding means 30 so as to engage the lowermost locating notch 46, it may, with thicker carpet sections, be necessary to engage the intermediate locating notch 46 (as shown in FIG. 3) or, with unusually thick carpet sections, the uppermost notch 46.

To facilitate variable positioning of the cutting edge 28 below the lower surface 16, there is provided in one side of the housing 32 a window 58 through which the positioning of the upper end 36 of the blade holding means 30 can be seen. A position indication scale 60 can be engraved or marked on the outside of the housing 32 as shown, the scale 60 being calibrated and marked in terms of the distance of protrusion of the cutting edge 38 below the lower surface 20, or, preferably, in terms of the thickness of the carpet sections 12*a*, 12*b* to be cut.

It is also preferable to provide cutting indicator means 62, which means indicate the operative plane of the cutting edge 28. As shown, such cutting indicator means 62 is comprised of the leading edge 62*a* of a generally triangular shaped wedge 64 secured to the leading edge 68 of the base plate 16. The triangular shaped wedge 64 is so positioned so that the leading edge 62*a* thereof is aligned with the operative plane of the cutting edge 28, such that, during use, the installer may align the leading edge 62*a* with a line or other marking on the carpet sections 12*a*, 12*b*. The cutting indicator means may, in other embodiments, more simply constitute a line on the upper surface 18 of the base plate 16, the line being similarly aligned with the operative plane of the cutting edge 28.

The preferred cutting device 10, illustrated, additionally comprises a means 66 for separating the pile of the carpet sections 12*a*, 12*b* prior to cutting, this means consisting of the triangular shaped wedge 64 previously discussed. The leading edge 62*a* of the triangular shaped wedge 64 is generally vertically oriented, and the trailing edge 62*b* (shown in phantom in FIG. 2) slopes upwardly rearwardly. In use, the pile separating means 66 urges the protruding portions of the individual pile fibres to either side of the proposed line of cutting, prior to actual cutting, so as to clear a path for the cutting edge 28, which cutting edge trails thereafter in a cutting stroke, when the cutting device 10 is moved in the direction of the arrow of FIG. 3. Such preliminary separation tends to minimize the "carpet shaving" phenonmena previously discussed, or it lessens the probability of a particular pile fibre being shared by the cutting edge 28. In this manner, it will be appreciated that the pile separating means 66 is positioned on the base plate 16 ahead of and in operative alignment with the cutting edge 28.

To maintain the generally vertical orientation of the cutting edge 28 during use of the device 10, which orientation is essential to obtain "exactly even" matches and to minimize carpet shaving, it is essential to keep the base plate 16 level (i.e. in generally parallel relationship to the planes of the overlapped carpet sections 12*a* and 12*b*), as shown in FIG. 1. It will be appreciated from the Figures, and particularly FIGS. 1 and 1*a*, that it is necessary to extend the length of one side plate 22, (the one overlying lower carpet section 12*a*), if such levelness is to be maintained. For this reason, one or more adjustment sleeves 68 are slidably engageable (as indicated by the phantom arrow of FIG. 2) with the side plates 22 so as to provide for level operative positioning of the base plate over the two overlapped carpet sections 12*a* and 12*b* positioned for cutting therebeneath. As shown in phantom outline in FIG. 2, the adjustment sleeve 68 may be of variable height, so as to accommodate overlapping of carpet sections 12*a* and 12*b* of varying thickness, all the while maintaining the aforementioned level relationship between the base plate 16 and the underlying carpet sections 12*a*, 12*b* Key means 70 are provided on the inner surface of each of the side plates 22, and corresponding keyway means 72 are provided on each of the inner side surfaces of a centrally positioned longitudinal slot 74 of the adjustment sleeve 68. By providing the keyway means 72 on both of said inner side surfaces, the sleeve 68 is thereby made reversible, so that the same casting or mould can be used for producing sleeves for the opposite other side plate 22. The slot 74 can then be crimped or otherwise closed at one end (which determines its right or left handedness) to prevent the adjustment sleeve 68 from simply sliding free of the side plate 22 when the device 10 is moved in the forward direction is shown by the solid arrow of FIG. 3. It is most desirable to provide a set of sleeves of varying vertical height, which set would typically have sleeves varying in height by increments of, for example, one eighth of an inch. Use of such a set of sleeves would adapt the device 10 for use with all commonly used thicknesses of carpet.

In order to facilitate maintenance of the aforesaid level operative positioning of the base plate 16 with the overlapped carpet sections 12*a* and 12*b*, there is also preferably provided a level indicator means 76 centrally positioned on upper surface 18 of the base plate 16. Such level indicator means 76 are well known, and may even be adapted from commercially available self-adhesive units. In this manner, the installer simply has to select the appropriate adjustment sleeve 68 which gives a level reading in the level indicator means 76 when the device 10 is positioned over the overlapped carpet sections 12*a* and 12*b* as shown in FIG. 1.

In use, the carpet installer overlaps the carpet sections 12*a* and 12*b* to be matched, and, if necessary, selects a suitable adjustment sleeve 68 to obtain a level reading on the level indicator means 76, if an "exactly even" match is desired. If a "thick" match is desired, a sleeve should be chosen so that the operative left side of the device (as seen in FIG. 1) is slightly lower than the operatively right side. Conversely, if a "thin" match is desired, the operatively left side of the device (as seen in FIG. 1) should be higher than the operatively right side of the device 10. Once this is done, the position of the blade means 26 is adjusted by manipulation of the threaded handle 44 as previously discussed. Then, the cutting indicator means 62 is aligned with the desired cut line A, and the installer 78 grasps the handle member 24 as indicated in FIG. 1, and thereafter pushes forwardly and slighly downwardly on the handle member 24 so as to move the device in the direction of the solid arrow of FIG. 3, all the while keeping the cutting indicator means 62 in alignment with the desired cutting line A. The cutting line A may be either marked on the uppermost carpet section 12*b*, or may be an imaginary line.

Once the sections 12*a* and 12*b* are cut in this manner, they are simply placed into relatively flush matched orientation, as shown in FIG. 1*b*.

While but a single embodiment of the invention is described herein in detail, it will be appreciated by those skilled in the art that considerable modifications to the device 10 may be made without departing from the spirit and scope of the invention. For example, the handle member 24 may be detachable from the base plate 16 for storage, so long as it is rigidly attached thereto in use. Additionally, the angle of the longitudinal axis of the handle member 24 to the plane of the base plate 16 may vary considerably and still obtain considerable improvement over prior art devices, although the preferred angle approximates 19° from absolute vertical. The selection of the exact angle to be used will be apparent from routine experiment. The pile separator means may be entirely omitted from the device whilst still achieving improved results. The side plates 22 need not be integrally formed with the base plate 16, as shown, but may, instead, be slidably engaged to upturned peripheral flanges of the base plate (not shown), so as to be adjustably slidable in relation to the base plate. Such slidably adjustable side plates would do away with the need for separate adjustment sleeves 68, as previously described. It may also be desirable to have the side plates 22 slant slightly downwardly towards the rear to the base plate 16, the necessity and degree of which slant is also a matter of routine experiment. Various other types of blade holding means 30 and blade means 26 can be readily adapted to this device by those skilled in the art without the exercise of inventive ingenuity and indeed, the device may be made with an integrally fixed blade means, which type of device could be suitably dimensioned and constructed so as to be disposable.

I claim:

1. A device for cutting a matched seam from two overlapped sections of pile carpet, the device being adapted for use with a blade means having a cutting edge, and comprising:

a generally planar base plate having an upper and a lower surface;

at least two generally planar side plates mounted on the base plate adjacent respective opposed side edges of the base plate so as to protrude downwardly below said lower surface;

a substantially hollow handle means forming a housing having a longitudinal axis, the handle being rigidly affixed to the upper surface of the base plate between the side plates with said longitudinal axis in angled relation to said upper surface and the housing overlying a longitudinal slot formed in the base plate;

a blade holding means adapted to rigidly hold the cutting blade in protruding relation through the slot between said at least two side plates is generally parallel relation to said longitudinal axis and said side plates, wherein the blade holding means is adjustably mounted within the housing so as to provide for variable positioning of the cutting edge below the lower surface of the base plates in operative cutting relation to said sections of pile carpet;

whereby said side plates displace downwardly applied force away from said blade means.

2. A device according to claim 1, wherein said blade holder is adapted for said adjustable mounting in generally sliding parallel relation to the longitudinal axis.

3. A device according to claim 2, wherein said side plates are mounted on the base plate in generally parallel relation to one another.

4. A device according to claim 3, wherein, in use, one or more adjustment sleeves are slidably engageable with the side plates to provide for level operative positioning of the base plate over two overlapped sections of carpet positioned for cutting therebeneath.

5. A device according to claim 4, wherein, key means are provided on each of the side plates and corresponding keyway means are provided on the adjustment sleeves to provide for positive positioning of the adjustment sleeves on the side plates, as aforesaid.

6. A device according to claim 5, wherein said longitudinal axis is positioned centrally of the side plates.

7. A device according to claim 6, wherein said blade holding means additionally comprises a threaded rod means aligned with said longitudinal axis so as to protrude at a free end through an end of the housing and threaded handle means positioned on the threaded rod adjacent said free end so as to engage the threaded rod thereby to draw said blade holder means into said housing so as to provide for said variable positioning of the blade means.

8. A device according to claim 7, including a position indication scale integrated with the handle means to indicate the operative position of the blade holding means.

9. A device according to claim 8, including cutting indicator means positioned on the base plate so as to indicate the operative plane of the cutting edge.

10. A device according to claim 9 additionally comprising means for separating the pile of said carpet said means being positioned on the base plate ahead of and in operative alignment with said cutting edge.

11. A device according to claim 10, including level indicator means positioned on the upper surface of the base plate.

* * * * *